US006389872B1

(12) United States Patent
Hanson

(10) Patent No.: US 6,389,872 B1
(45) Date of Patent: May 21, 2002

(54) MANDREL APPARATUS WITH FLOATING SPRING MEMBERS

(75) Inventor: Beverley F. Hanson, Sherwood Park (CA)

(73) Assignee: CRC-Evans Pipeline International, Inc., Houston, TX (US)

( * ) Notice: Subject to any disclaimer, the term of this patent is extended or adjusted under 35 U.S.C. 154(b) by 0 days.

(21) Appl. No.: 09/653,290

(22) Filed: Aug. 31, 2000

(51) Int. Cl.[7] ..... B21D 9/01
(52) U.S. Cl. ..... 72/466.2; 72/398; 72/466.9
(58) Field of Search ..... 72/307, 369, 370.01, 72/370.08, 398, 465.1, 466.2, 466.8, 466.9, 478

(56) References Cited

U.S. PATENT DOCUMENTS

| | | | | |
|---|---|---|---|---|
| 336,854 | A | 2/1886 | Higgins | |
| 856,896 | A | 6/1907 | McCormick | |
| 2,380,344 | A | 7/1945 | Sutton | 153/63 |
| 2,401,052 | A | 5/1946 | Cummings | 153/63 |
| 2,734,120 | A | 2/1956 | Sensenig | 219/17 |
| 2,734,749 | A | 2/1956 | Benjamin | 279/2 |
| 2,835,498 | A | 5/1958 | Howes | 279/51 |
| 3,109,477 | A | 11/1963 | Avera et al. | 153/63 |
| 3,115,798 | A | 12/1963 | Donaway | 82/34 |
| 3,117,797 | A | 1/1964 | Buck | 279/2 |
| 3,383,723 | A | 5/1968 | Connelly | 10/107 |
| 3,747,394 | A | 7/1973 | Cunningham | 72/466 |
| 3,834,210 | A | 9/1974 | Clavin et al. | 72/308 |
| 3,851,519 | A | 12/1974 | Calvin et al. | 72/466 |
| 3,964,290 | A | 6/1976 | Auxer | 72/466 |
| 3,979,941 | A | 9/1976 | Auxer | 72/466 |
| 4,027,522 | A | 6/1977 | Clavin | 72/466 |
| 4,086,803 | A | 5/1978 | Wheeler | 72/466 |
| 4,164,135 | A | 8/1979 | Clavin | 72/466 |
| 4,246,814 | A | 1/1981 | Pertle | 82/4 C |
| 4,313,330 | A | 2/1982 | Cummings | 72/307 |
| 4,331,016 | A | 5/1982 | Benteler et al. | 72/133 |
| 4,352,285 | A | 10/1982 | LaRue et al. | 72/466 |
| 4,493,203 | A | 1/1985 | Wheeler et al. | 72/369 |
| 5,586,462 | A | 12/1996 | Takeuchi et al. | 72/150 |
| 6,298,706 | B1 * | 10/2001 | Dunn | 72/369 |

FOREIGN PATENT DOCUMENTS

| | | | |
|---|---|---|---|
| DE | 195 12 646 | 10/1996 | |
| EP | 0 783 927 | 7/1997 | |
| EP | 0 786 293 | 7/1997 | |
| FR | 74 18742 | 12/1975 | |
| JP | 6-198349 | * 7/1994 | B21D/9/03 |
| RU | 288498 | 12/1970 | |
| RU | 940918 | 7/1982 | |
| RU | 1015959 | 5/1983 | |
| RU | 1466084 | 6/1995 | |
| RU | 1630120 | 6/1995 | |

* cited by examiner

*Primary Examiner*—Ed Tolan
(74) *Attorney, Agent, or Firm*—Sidley Austin Brown & Wood LLP

(57) ABSTRACT

A mandrel for insertion into a pipe prevents distortion and buckling while bending the pipe. The mandrel comprises three or more radial support members distributed along a longitudinal extent of the mandrel. A first radial support member is located at a first end of the mandrel. A second radial support member is located at a second end of the mandrel. At least one intermediate radial support member is located between the first and second radial support members. A channel is formed in the at least one intermediate radial support member. A leaf spring extends along the longitudinal extent of the mandrel, and the leaf spring is located within the radial support member channel. The leaf spring has a first and second spring end. A first end bolt attaches the first spring end to the first radial support member. A second end bolt attaches the second spring end to the second radial support member. A compliant member attaches to the leaf spring by a compliant member bolt. The channel is shaped and dimensioned such that the compliant member bolt does not contact the channel. The leaf spring is capable of moving relative to the at least one intermediate radial support member within the channel.

24 Claims, 4 Drawing Sheets

MANDREL APPARATUS WITH FLOATING SPRING MEMBERS

TECHNICAL FIELD OF THE INVENTION

The present invention relates to a mandrel for providing internal support during the cold bending of large diameter pipes. In particular, the present invention relates to a mandrel having spring members that are adapted to bias against an internal surface of a pipe during cold bending to prevent buckling and distortion.

BACKGROUND OF THE INVENTION

Mandrels are well known for providing internal support to a pipe to avoid buckling or wrinkling of the pipe wall while the pipe is being bent. For example, as disclosed in U.S. Pat. No. 3,834,210 to Clavin, et al., a mandrel apparatus is known for use with a pipe bending apparatus for bending large diameter pipes of the type used for oil and gas pipelines. The pipes used in such pipelines are typically formed of steel and can have a wall thickness in excess of one inch and a diameter in excess of forty-eight inches. Hence, a mandrel apparatus must be very robust to withstand the tremendous forces necessarily used when bending large pipes of this type.

A typical mandrel (e.g., as disclosed in U.S. Pat. No. 4,352,285 to LaRue, et al.) used in bending large diameter pipes includes semi-cylindrical support assemblies which are radially movable toward and away from one another in the plane of bending. For example, if the pipe will be bent in the vertical plane, then the mandrel will have top and bottom support assemblies which are vertically movable with respect to one another. After the mandrel is positioned within the bore of the pipe at the position designated for the bend, the support assemblies are moved radially outward into contact with the interior walls of the pipe and biased to exert an outward force. External forces are then applied to the pipe, bending it to form the desired configuration. During the bending process, the support assemblies of the mandrel deflect to remain in contact with the interior of the pipe walls. The outward force provided by the support assemblies prevents the walls of the pipe from bending inward to form buckles or wrinkles.

Mandrels of the type disclosed in U.S. Pat. No. 4,352,285 have support assemblies which include a plurality of buckle-resistant spring units. Each spring unit is formed of several elongate flat springs fastened together in a laminar stack. The spring units are fastened longitudinally to a plurality of transversely oriented arcuate support segments to form a semi-cylindrical array. The arcuate support segments are, in turn, mounted to spring plates that can be moved with respect to one another to move the support assemblies into the desired position.

During bending, the pipe wall farther from the center of bending is subjected to tension forces and the pipe wall nearer to the center of bending is subjected to compression forces. The support assemblies, which maintain contact with the pipe walls during bending, are likewise subjected to substantial tension and compression forces. These forces, along with the deflection of the spring units, urge elements of the spring units to shift with respect to one another.

The compression forces imposed on the mandrel during the bending of a pipe are large. Because of such forces, components of the mandrel are likely to break and/or become nonfunctional. The bolts attaching the bottom (tension-side) spring units to the support segments frequently break. As the region of the pipe being bent compresses on the mandrel, a shearing force is created between the spring units and the support segments. If the shearing force is greater than the shear strength of the bolt, the bolt breaks leaving a portion of it buried within the support segment. Then, the remains of the bolt must be removed and replaced to prevent an improper bend and/or buckling in the pipe. Much time and effort is required to remove and replace a broken bolt imbedded in a support segment, thereby delaying the production of a bent pipe.

Therefore, a need exists for a mandrel that is not only durable and effective for bending pipe, but which can also be easily repaired and maintained.

SUMMARY OF TEE INVENTION

Many of the needs outlined above are addressed by the present invention hereof. Hence, it is an object of the present invention to provide a mandrel that is durable and effective for bending pipe, as well as easily repaired and maintained.

In accordance with one aspect of the present invention, a mandrel is provided for insertion into a pipe to prevent distortion and buckling while bending the pipe. The mandrel comprises three radial support members distributed along a longitudinal extent of the mandrel. A first radial support member is located at a first end of the mandrel. A second radial support member is located at a second end of the mandrel. A third radial support member is located between the first and second radial support members. A channel is formed in the third radial support member. A leaf spring extends along the longitudinal extent of the mandrel, and the leaf spring is located within the channel. The leaf spring has a first and second spring end. A first end bolt attaches the first spring end to the first radial support member. A second end bolt attaches the second spring end to the second radial support member. The leaf spring is capable of moving relative to the third radial support member within the channel.

In accordance with another aspect of the present invention, a mandrel is provided for insertion into a pipe to prevent distortion and buckling while bending the pipe. The mandrel comprises a compliant member attached to a leaf spring member by a compliant member bolt. The leaf spring member extends along a longitudinal extent of the mandrel. A channel is formed in a radial support member, and the leaf spring member is located within the channel. The channel is shaped and dimensioned such that the compliant member bolt does not contact the channel.

In accordance with yet another aspect of the present invention, a mandrel is provided for insertion into a pipe to prevent distortion and buckling while bending the pipe. The mandrel comprises a plurality of leaf spring members, a plurality of radial support members, and end bolts. Each of the leaf spring members extends along a longitudinal extent of the mandrel. Also, each of the leaf springs has a first spring end and a second spring end. A plurality of compliant members attach to each of the leaf spring members by a corresponding compliant member bolt. The radial support members are distributed along the longitudinal extent of the mandrel. A first radial support member is located at a first end of the mandrel. A second radial support member is located at a second end of the mandrel, and at least one intermediate radial support member is located between the first and second radial support members. A plurality of channels are formed in and distributed along an arcuate direction of each of the radial support members. The leaf spring members are correspondingly located within the channels. Each of the channels is shaped and dimensioned such that none of the compliant member bolts come into contact with any of the channels during use of the mandrel. A first end bolt correspondingly attaches one of the first spring ends to the first radial support member for each of the leaf spring members. A second end bolt correspondingly attaches one of the second spring ends to the second radial support member for each of the leaf spring members. The leaf spring members are capable of moving relative to the at least one intermediate radial support member within the channels formed in the at least one intermediate radial support member.

BRIEF DESCRIPTION OF THE DRAWINGS

Other objects and advantages of the invention will become apparent upon reading the following detailed description and upon reference to the accompanying drawings in which.

DETAILED DESCRIPTION OF THE INVENTION

Figure 1:
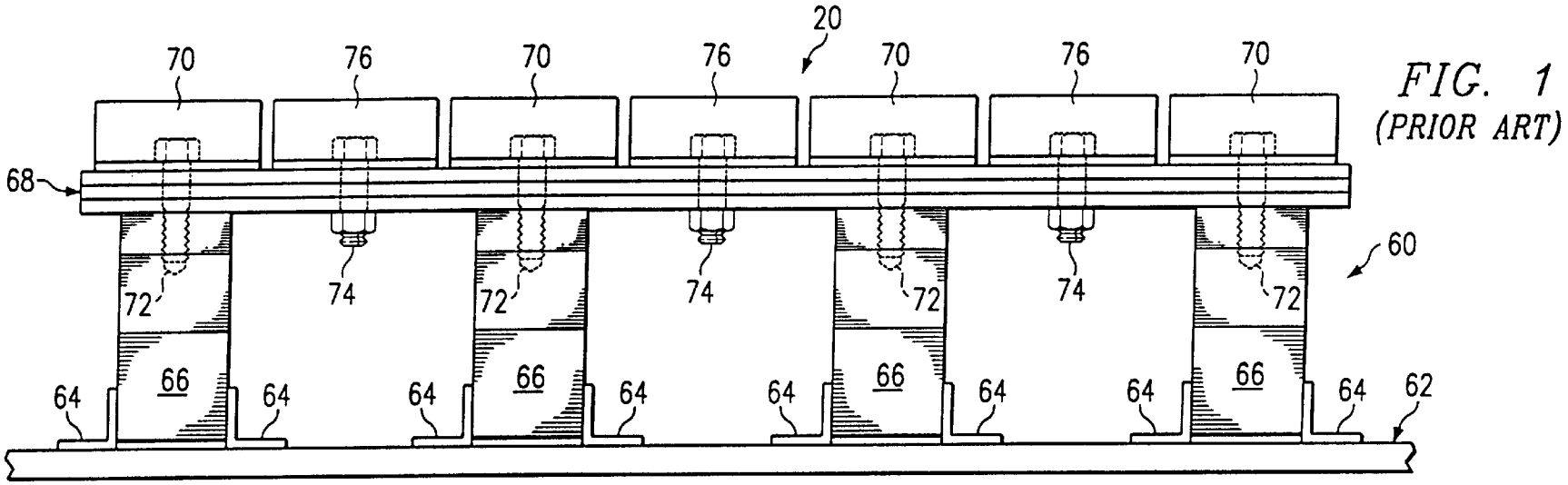
FIG. 1 (PRIOR ART)
FIG. 1 is a side view of a bottom assembly (inverted for viewing purposes) of a mandrel in the prior art.

Referring now to the drawings, wherein like reference numbers are used to designate like elements throughout the various views, several embodiments of the present invention are further described.

Figure 2:
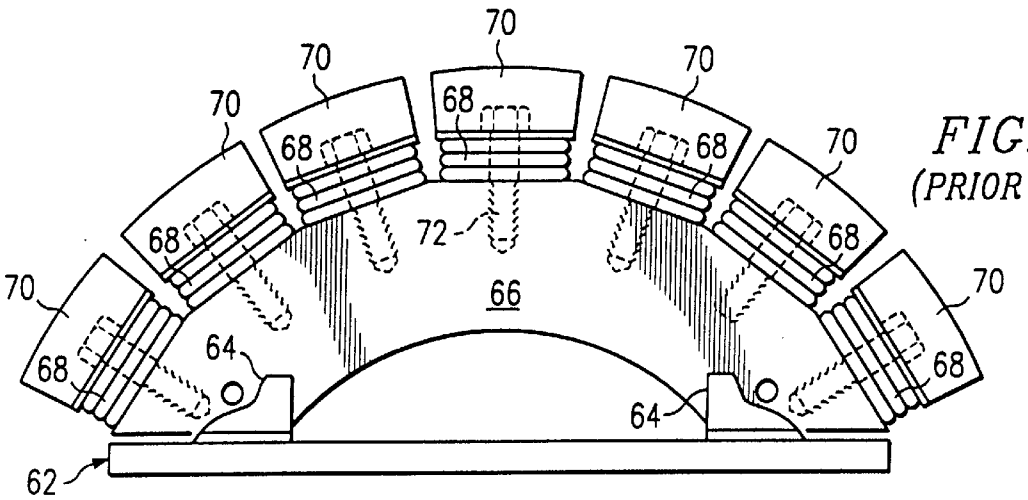
FIG. 2 (PRIOR ART)
FIG. 2 is an end view of a radial support segment of a mandrel in the prior art.

FIGS. 1 and 2 show relevant portions of a mandrel 20 in the prior art, which will be referenced below to illustrate the improvements provided by the present invention.

Figure 3:
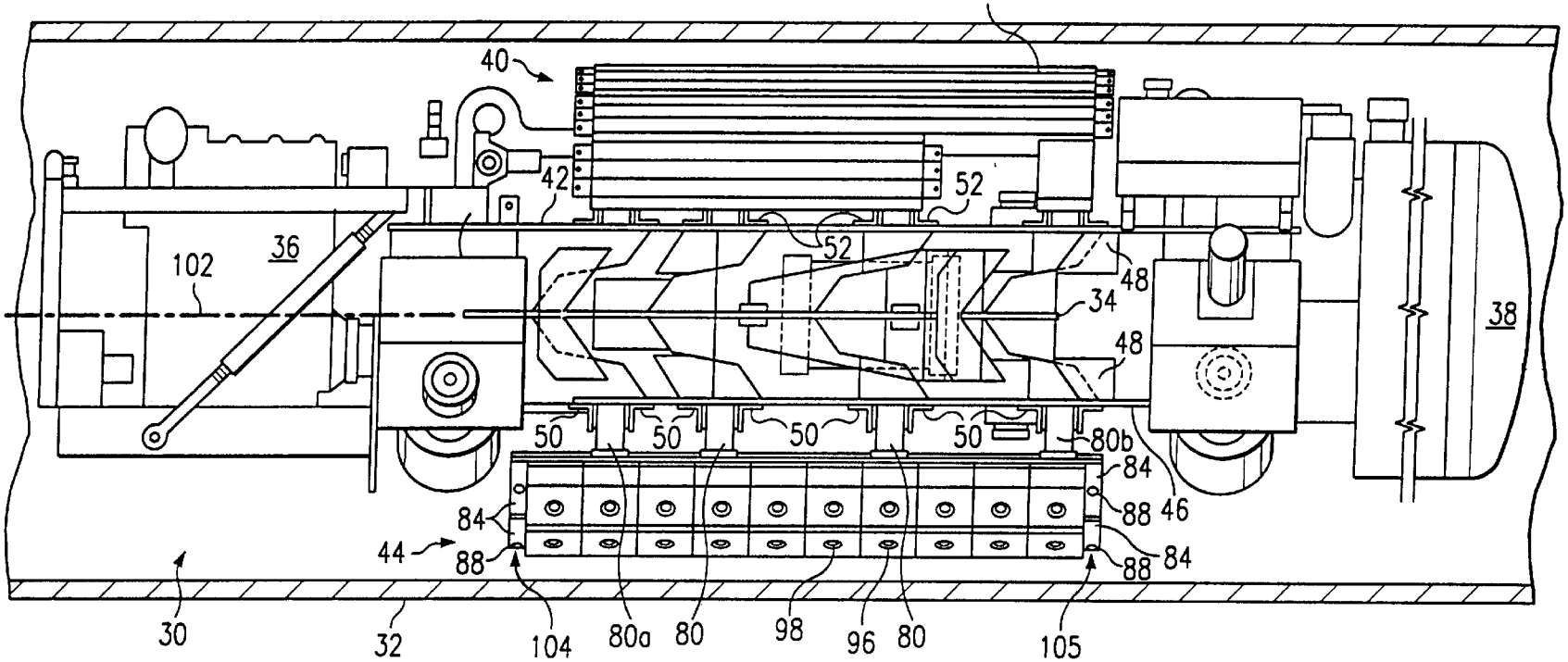
FIG. 3 is a side view of a mandrel in accordance with a first embodiment of the present invention.

FIG. 3 is a side view of a mandrel 30 with floating spring members in accordance with a first embodiment of the present invention. The mandrel 30 shown in FIG. 3 is in a collapsed position within a pipe 32. Such a collapsed position allows the mandrel 30 to be inserted into and removed from the pipe 32. The mandrel 30 includes a center plate 34, motor 36, hydraulic tank 38, top assembly 40, top plate 42, bottom assembly 44, and bottom plate 46. The center plate 34 is mechanically connected to the top plate 42 and the bottom plate 46 by wedges 48. The bottom assembly 44 is attached to the bottom plate 46 by bottom brackets 50. The bottom assembly 44 is on the tension side during bending of the pipe 32. The top assembly 40 is attached to the top plate 42 by top brackets 52, and the top assembly 40 is on the compression side during bending. The motor 36 engages the wedges 48 to push the top plate 42 and bottom plate 46 radially apart, and thus engaging the inside surface of the pipe 32, which is the position of the mandrel 30 during bending (not shown).

FIG. 1 is a side view of a bottom assembly 60 (inverted) of the mandrel 20 in the prior art. The bottom assembly 60 includes a bottom plate 62, bottom brackets 64, radial support segments 66, leaf spring members 68, urethane pads 70, spring bolts 72, and pad bolts 74. The radial support segments 66 are fixed to the bottom plate 62 by bottom brackets 64. As best shown in FIG. 2, each radial support segment 66 has a round, arc shape corresponding to the contour of an interior wall of a pipe. The urethane pads 70 located radially above a radial support segment 66 are each attached to the radial support segment by a spring bolt 72. Spring bolt 72 projects through leaf spring member 68 and into the top of radial support segment 66, which fixes the leaf spring and the urethane pad to the radial support segment. Referring again to FIG. 1, other urethane pads 76 located between radial support segments 66 are only attached to the corresponding leaf spring member 68 by a pad bolt 74. This arrangement of components for the bottom assembly 60 in the prior art prevents the longitudinal and arcuate movement of the urethane pads 70 and the leaf spring members 68 relative to radial support segments 66 during use of the mandrel 20. However, such arrangement does not prevent the shearing of the spring bolts 72, which is a frequent occurrence during the use of this prior art mandrel design. When a spring bolt 72 is sheared during a bending operation, typically the sheared bolt must be removed and replaced. Due to the location of the spring bolts 72, the mandrel 20 often must be removed from the pipe and partially disassembled to repair the sheared bolt. Also, because the bolt tip is typically left embedded within radial support segment 66 after shearing, the remains of the sheared bolt are difficult to remove. Hence, the repair of a sheared spring bolt often creates bending production downtime and substantial effort to repair the mandrel 20.

Figure 4:
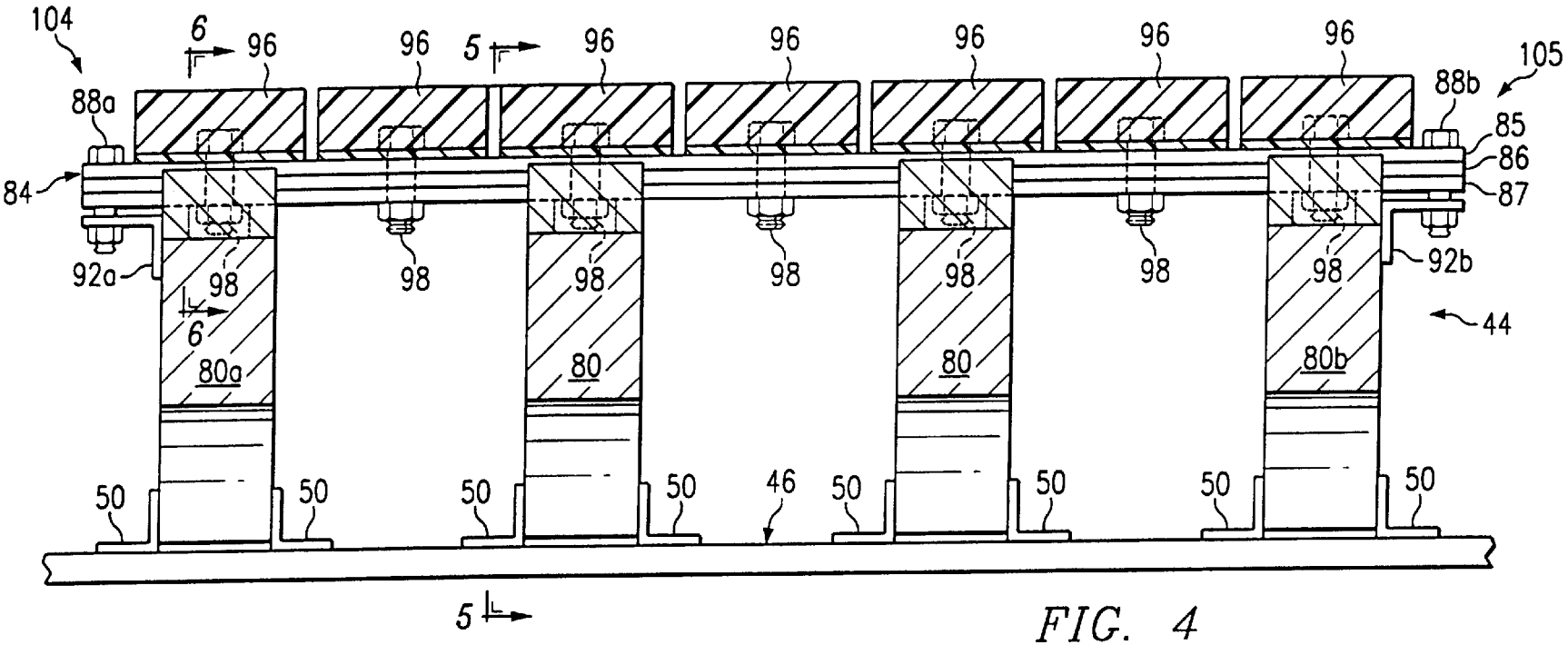
FIG. 4 is a vertical section of a bottom assembly (inverted for viewing purposes) of the first embodiment in FIG. 3.

FIGS. 3–6 show the first embodiment of the present invention, which greatly improves upon the design of a mandrel. Specifically, FIG. 4 shows a vertical section view of the bottom assembly 44 (inverted for illustration), which is on the tension side during bending. The bottom assembly 44 includes the bottom plate 46, radial support segments 80, bottom brackets 50, leaf spring members 84, end bolts 88, end brackets 92, compliant members 96, and compliant member bolts 98. The radial support segments 80 attach to the bottom plate 46 by bottom brackets 50. The attachment of the radial support segments 46 to the bottom plate may be accomplished by various known means, including, but not limited to: bolts, welds, interfitting joints, or combinations thereof.

Figure 5:
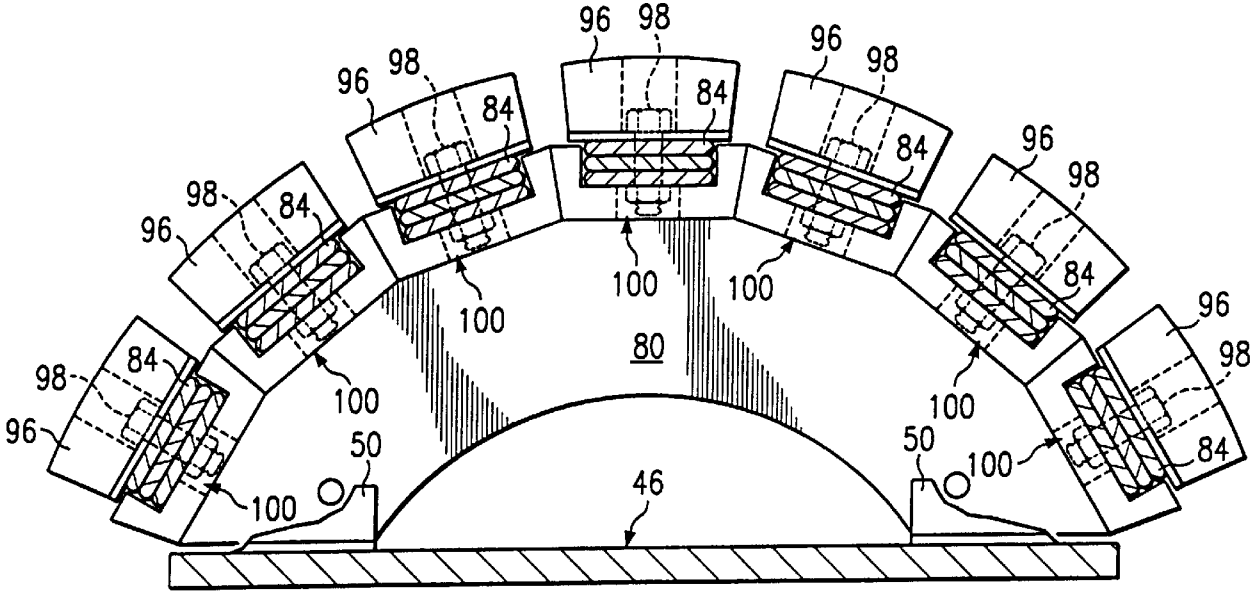
FIG. 5 is an end view of a radial support segment of the bottom assembly of the first embodiment in FIGS. 3 and 4.

As shown in the end view of FIG. 5, the radial support segments 80 have a round, arc shape corresponding to the contour of an interior wall of the pipe 32. Each of the compliant members 96 is attached to a corresponding leaf spring member 84 by a compliance member bolt 98. The compliance member 96 may be made from any of various compliant materials, including, but not limited to: urethane, plastic, or rubber.

A set of channels 100 is formed in each radial support segment 80. The channels 100 are distributed along an arcuate direction of the radial support segment 80 for receiving leaf springs members 84. Each leaf spring member 84 extends along a longitudinal extent of the mandrel 30, which is generally parallel to a longitudinal axis 102 of the mandrel (see FIG. 3). Each leaf spring member 84 has three leaf spring elements 85, 86, 87 for forming a composite or laminar leaf spring unit. However, many other know variations of a leaf spring member may be substituted, and the number of layers may vary.

Figure 6:
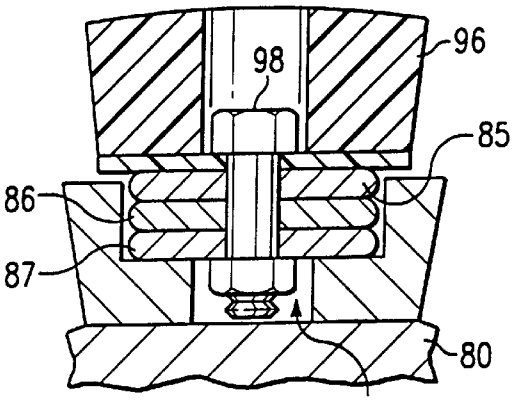
FIG. 6 is an enlarged partial end view of a leaf spring member within a channel of a radial support segment in the first embodiment in FIGS. 3–5.

As shown in FIGS. 5 and 6, each leaf spring member 84 is positioned within a corresponding channel 100 for each radial support segment 80. Each channel is shaped and dimensioned so that the compliance member bolts 98 do not engage or contact the walls of the channel 100, nor the corresponding radial support segment 80. Thus, the leaf spring members 84 and compliance members 96 are free to move longitudinally within the channels 100.

As best shown in FIG. 4, the ends 104, 105 of the leaf spring members 84 are attached to the outside of the end most radial support segment 80*a*, 80*b*, respectively, by end bolts 88*a*, 88*b*. Each end bolt 88*a*, 88*b* projects through a corresponding end 104, 105 of a leaf spring member 84 and through a corresponding end bracket 92*a*, 92*b*. Each end bracket 92*a*, 92*b* is attached to the corresponding end radial support segment 80*a*, 80*b*. The end brackets 92*a*, 92*b* may be attached to the end radial support segments 80*a*, 80*b* by any of various known means, including, but not limited to: bolts, welds, interfitting joints, or some combination thereof. In one alternative embodiment, the end brackets 92*a*, 92*b* may be integrally formed on a radial support segment 80*a*, 80*b*.

By fastening the leaf spring members 84 at only the ends 104, 105, the central portions of the leaf spring members (between the ends) may freely move (i.e., float) longitudinally relative to the radial support segments 80. Hence, because the leaf spring members 84 can float during a bending operation using the mandrel 30, the end bolts 88 holding the leaf spring members 84 in place are less likely to shear. But, if an end bolt 88 does shear during the use of the mandrel 30 according to the first embodiment, the mandrel can be more easily repaired because the entire mandrel will probably not need to be removed from the pipe 32 to make the bolt replacement. Also, because the end bolts 88 are not embedded in the radial support segments 80 after shearing, the sheared bolts are easier to access and remove. Therefore, the removal and replacement of the end bolts 88 can be performed quickly and easily because they are located on the ends 104, 105 and outside of the end radial support segments 80*a*, 80*b*.

Referring to FIG. 3, and particularly the top assembly 40, mandrels often further include a layer of buckle resistant strips 108. Such buckle resistant strips 108 can be attached to the bottom assembly 44 using end brackets 92*a*, 92*b* via end bolts 88*a*, 88*b*. In this case, end bolts of an appropriate length would be used. In this embodiment, the compliant members 96 would be sandwiched between the buckle resistant strips 108 and the leaf spring members 84. It should be noted that the present invention, described above for use on the bottom assembly 44 (tension side) in the first embodiment, may also be applied to the top assembly 40 (compression side).

Figure 7:
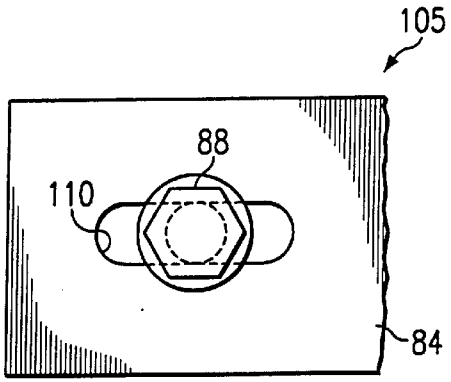
FIG. 7 is a partial top view of an end bolt attaching to a leaf spring member through an elongated slot in accordance with a second embodiment of the present invention.

FIG. 7 shows a further embodiment of the present invention. As discussed above regarding the first embodiment, the end bolts 88 project through the ends 104, 105 of the leaf spring members 84 to attach the leaf spring member ends to the end radial support segments 80*a*, 80*b*, respectively. In this embodiment, the holes in the leaf spring members 84, through which the bolts project, are elongated slots 110. Thus, the leaf spring members 84 are more able to move (float) longitudinally relative to the end radial support segments 80*a*, 80*b*. Also, each of the leaf spring elements 85, 86, 87 is free to slide relative to each other. This provides more freedom of movement for the leaf spring members 84 at the ends 104, 105, and thus further relieves longitudinal shear stress build up within the leaf spring members 84 and the end bolts 88*a*, 88*b* during use of the mandrel 30. Hence, with the second embodiment, the longitudinal shear stress experienced by the end bolts 88*a*, 88*b* is prevented or further reduced.

It will be appreciated by those skilled in the art having the benefit of this disclosure that this invention provides an improved mandrel design. It should be understood that the drawings and detailed description herein are to be regarded in an illustrative rather than a restrictive sense, and are not intended to limit the invention to the particular forms disclosed. On the contrary, the invention includes any further modifications, changes, rearrangements, substitutions, alternatives, design choices, and embodiments apparent to those of ordinary skill in the art, without departing from the spirit and scope of this invention, as defined by the following claims. Thus, it is intended that the following claims be interpreted to embrace all such further modifications, changes, rearrangements, substitutions, alternatives, design choices, and embodiments.

What is claimed is:

1. A mandrel for inserting into a pipe to prevent distortion while bending said pipe, said mandrel comprising:

first, second and third radial support members positioned along a longitudinal extent of the mandrel, said first radial support member located at a first point on the mandrel, said second radial support member located at a second point on the mandrel, and said third radial support member located between said first and second radial support members;

a spring member extending along the longitudinal extent of the mandrel;

a first attachment structure for attaching said spring member to said first radial support member; and a second attachment structure for attaching said spring member to said second radial support member, wherein said spring member is moveable relative to said third radial support member.

2. A mandrel in accordance with claim 1, further comprising:

a channel formed in said third radial support member for receiving said spring member therein.

3. A mandrel in accordance with claim 1, further comprising:

a plurality of compliant members attached to said spring member, wherein said compliant members are distributed along the longitudinal extent of the mandrel.

4. A mandrel in accordance with claim 3, wherein said compliant members are made from urethane.

5. A mandrel in accordance with claim 3, wherein said compliant members are attached to said spring member by compliant member bolts.

6. A mandrel in accordance with claim 5, wherein a channel is formed in said third radial support member for receiving said spring member therein, said channel being shaped and dimensioned such that none of said compliant member bolts come into contact with said channel.

7. A mandrel in accordance with claim 1, further comprising:

at least one additional radial support member, wherein said at least one additional radial support member is located between said first and second radial support members along the longitudinal extent of the mandrel.

8. A mandrel in accordance with claim 1, wherein said third radial support member has a plurality of channels formed therein, such that said channels are distributed along an arcuate direction of said third radial support member.

9. A mandrel in accordance with claim 8, further comprising:

a plurality of leaf springs, wherein said leaf springs are distributed along said arcuate direction of said third radial support member, and one of said leaf springs is (i) located within a corresponding channel of said channels and (ii) extends along said longitudinal extent of the mandrel.

10. A mandrel in accordance with claim 9, wherein each of said leaf springs has a plurality of compliant members distributed along the longitudinal extent of the mandrel.

11. A mandrel in accordance with claim 1, wherein each of said first and second radial support members has a plurality of channels formed therein, each of said channels has a corresponding spring member therein, and each of said corresponding spring members extends along the longitudinal extent of the mandrel.

12. A mandrel in accordance with claim 11, further comprising:

a plurality of compliant members attached to each of said corresponding spring members.

13. A mandrel in accordance with claim 1, wherein said first attachment structure is attached to said spring member through a first elongated slot formed in said spring member, such that said spring member can move longitudinally relative to said first radial support member.

14. A mandrel in accordance with claim 13, wherein said second attachment structure is attached to said spring through a second elongated slot formed in said spring member, such that said spring member can move longitudinally relative to said second radial support member.

15. A mandrel in accordance with claim 1, wherein said spring member is attached to said first radial support member by a first bracket, and said first attachment structure extends through said first bracket.

16. A mandrel in accordance with claim 1, wherein said spring member is a composite leaf spring assembly comprising three, radially-stacked leaf spring layers.

17. A mandrel for inserting into a pipe to prevent distortion while bending said pipe, said mandrel comprising:

a compliant member attached to a spring member by a compliant member attachment structure, said spring member extending along a longitudinal extent of the mandrel; and a channel formed in a radial support member, wherein said spring member is within said channel, said channel being shaped and dimensioned such that said compliant member attachment structure does not contact said channel.

18. A mandrel in accordance with claim 17, wherein said leaf spring member comprises three leaf spring layers.

19. A mandrel in accordance with claim 17, wherein said compliant member attachment structure is a bolt.

20. A mandrel for inserting into a pipe to prevent distortion while bending said pipe, said mandrel comprising:

a plurality of leaf spring members, each of said leaf spring members (i) extending along a longitudinal extent of said mandrel, (ii) having a first spring end, and (iii) having a second spring end;

a plurality of compliant members attached to each of said leaf spring members by a corresponding compliant member bolt;

a plurality of radial support members distributed along said longitudinal extent, wherein a first radial support member is located at a first point on said mandrel, and a second radial support member is located at a second point on said mandrel, such that at least one intermediate radial support member is located between said first and second radial support members;

a plurality of channels formed in and distributed along an arcuate direction of each of said radial support members, wherein said leaf spring members are correspondingly located within said channels, each of said channels being shaped and dimensioned such that none of said compliant member bolts come into contact with any of said channels during use of said mandrel;

a first end bolt for correspondingly attaching one of said spring members to said first radial support member for each of said leaf spring members; and a second end bolt for correspondingly attaching one of said spring members to said second radial support member for each of said leaf spring members, wherein said leaf spring members are moveable relative to said at least one intermediate radial support member within said channels formed in said at least one intermediate radial support member.

21. A mandrel in accordance with claim 20, wherein said radial support members are attached to a bottom plate of said mandrel, said bottom plate being movably attached to a frame of said mandrel, and said bottom plate extending along said longitudinal extent.

22. A mandrel in accordance with claim 20, wherein each of said leaf spring members comprises multiple layers of leaf springs, and each of said compliant members is made from urethane.

23. A mandrel for insertion into a pipe to prevent distortion while bending said pipe, said mandrel comprising:

a plurality of radial support members positioned along a longitudinal extent of said mandrel, wherein one said radial support member is located at one point along the mandrel, a second radial support member is located at a second point along the mandrel, and a third radial support member located intermediate of said first and second radial support members;

a spring extending along said longitudinal extent of said mandrel; and attachment structure for mounting said spring relative to said first and second radial support members, wherein said spring is moveable relative to said third radial support member when said radial support members move during bending of said pipe.

24. A mandrel in accordance with claim 23, further comprising:

a channel formed in said third radial support member for receiving said spring therein.

* * * * *